US005244432A

United States Patent [19]

Moy Au et al.

[11] Patent Number: 5,244,432

[45] Date of Patent: Sep. 14, 1993

[54] PROTECTIVE AND SUPPORTIVE BRASSIERE

[76] Inventors: May N. Moy Au, 100 Manhattan Ave., New York, N.Y. 10025; Sheryl Unsworth, 680 Riverside Dr., Apt. 2A, New York, N.Y. 10031

[21] Appl. No.: 858,590

[22] Filed: Mar. 27, 1992

[51] Int. Cl.[5] ..... A41C 3/10; A41C 3/14

[52] U.S. Cl. ..... 450/54; 450/57; 450/61; 450/1; 2/267

[58] Field of Search ..... 2/73, 104, 267; 450/1, 450/31, 32, 37, 39, 40, 54, 55, 57, 59, 61, 66, 70

[56] References Cited

U.S. PATENT DOCUMENTS

| | | | |
|---|---|---|---|
| 939,712 | 11/1909 | Kleinert | 450/37 |
| 1,136,727 | 4/1915 | Smith | 450/836 |
| 1,845,011 | 2/1932 | Yerkes | 2/267 |
| 2,445,767 | 7/1948 | Dickerson | 450/39 |
| 2,579,365 | 12/1951 | Condé | 450/39 |
| 2,585,338 | 2/1952 | Meares | 450/37 X |
| 2,611,898 | 9/1952 | Laird | 2/267 |
| 2,657,386 | 11/1953 | Wolff | 2/267 |
| 2,707,281 | 5/1955 | Barth | 450/39 |
| 2,772,418 | 12/1956 | Spanel | 450/39 |
| 2,881,765 | 4/1959 | Sloate | 450/61 X |
| 3,176,686 | 4/1965 | Barnes | 450/39 X |
| 3,957,057 | 5/1976 | Farino | 450/61 |
| 4,217,905 | 8/1980 | Atwater et al. | 450/74 |
| 4,259,469 | 3/1981 | Lindgren | 450/61 |
| 4,261,366 | 4/1981 | Lamborn | 450/58 |
| 4,607,640 | 8/1986 | McCusker | 450/1 |
| 4,957,466 | 9/1990 | Hopps | 450/23 |
| 5,020,157 | 6/1991 | Dyer | 2/267 |
| 5,022,887 | 6/1991 | Lawson | 450/1 |
| 5,032,103 | 7/1991 | Larsson | 450/37 |
| 5,045,018 | 9/1991 | Costanzo | 450/31 |

FOREIGN PATENT DOCUMENTS

| | | | |
|---|---|---|---|
| 1282535 | 12/1961 | Fed. Rep. of Germany | 450/39 |
| 2291713 | 7/1976 | Fed. Rep. of Germany | 450/39 |
| 0792743 | 4/1958 | United Kingdom | 450/39 |

*Primary Examiner*—Clifford D. Crowder
*Assistant Examiner*—Jeanette E. Chapman
*Attorney, Agent, or Firm*—Michael G. Marinageli

[57] ABSTRACT

A comfortable brassiere containing removable, vented, cups with bands of shock absorbing material removably attached around the outer perimeter of the cups, for the protection and support of the breast area from excessive movement and damaging impact during activities which have a high incidence of physical contact.

6 Claims, 2 Drawing Sheets

PROTECTIVE AND SUPPORTIVE BRASSIERE

FIELD OF THE INVENTION

This invention relates generally to a brassiere and, more specifically, to a protective and supportive brassiere, having two vented, flexible, semi-rigid, shock absorbing cups, removably secured therein. In numerous cases, trauma received through physical contact when engaged in sports or other contact activities, has been responsible for various forms of infections of the breasts (mastitis). In some cases, mastitis has necessitated the removal of the injured breast by surgery (i.e. radical mastectomy) so as to delay a breast disease, such as a tumor, from setting in. Not only is the presently disclosed brassiere helpful in the protection of the female breast area from damaging impact during such activities, but it simultaneously provides healthy support to this portion of the upper body because it inhibits excessive breast movements when the body is in motion.

DESCRIPTION OF THE PRIOR ART

The use of a protective brassiere to safeguard the breast area from harmful injuries procured from participation in sports or other activities is generally known in the art but are lacking in certain ways. For instance, U.S. Pat. No. 3,176,686 entitled "Shock Absorbent Construction For Athletic Garments", does not show removable cups or the shock absorbing material around their rim. In U.S. Pat. No. 3,478,739 a "Protective Brassiere" is claimed which also does not have removable cups, is not made of a semi-rigid shock absorbing material surrounded by rubber around their rims. In addition, the cups have no vent holes for ariation of the skin around breast area. A "Breast Shield" is disclosed in U.S. Pat. No. 5,032,103, useful only for the protection of the breast nipples of nursing women.

Although somewhat helpful, none of these prior patents can protect the entire breast area of its wearer by disclosing the novel concept of having removable cups with wide bands of a shock absorbing material operatively connected around their rims so as to comfortably absorb any impact while simultaneously restraining the breasts from bouncing and excessive movement.

OBJECTS OF THE INVENTION

The brassiere disclosed herein is a very simplified structure which is constructed of a pair of thin walled semi-rigid plastic cups that are removably secured within the walls of a brassiere. Not only will these cups effectively absorb direct blows through the wide strips of rubber attached to the outer circumference of the cups but they will also help to comfortably keep the breasts from moving excessively during any given body activity. By reason of the novel construction of the cups, any shock or sudden impact received on any part of the breast will be deflected or absorbed by the rubber strips.

It is, therefore, the principal objective of the present invention to provide a novel and improved protective brassiere which reduces the incidence of sudden athletic and/or industrial breast impact leading to breast injury and disease, as noted above.

A further object of the present invention is to provide a novel and improved brassiere which effectively protects the entire breast area of the upper body.

Another object of the present invention is to permit the skin in the protected breast area to breath thus allowing the blood to circulate freely in the covered area.

Yet another object of the present invention is to provide support to the upper portion of the body by inhibiting excessive breast movement during body movement.

Another object of the invention is to provide a brassiere that has easily removable protective cups which can be cleaned and washed after each use thereby having sanitary advantages.

Still a further object of the present invention is to provide a protective and supportive brassiere which is easy to manufacture and use.

Other objects, advantages and novel features of the invention will become readily apparent to those skilled in the art from the following detailed description of the invention when considered in conjunction with the attached drawings wherein like reference numbers identify like parts throughout.

DETAILED DESCRIPTION OF THE INVENTION IN A PREFERRED EMBODIMENT

Figure 1:
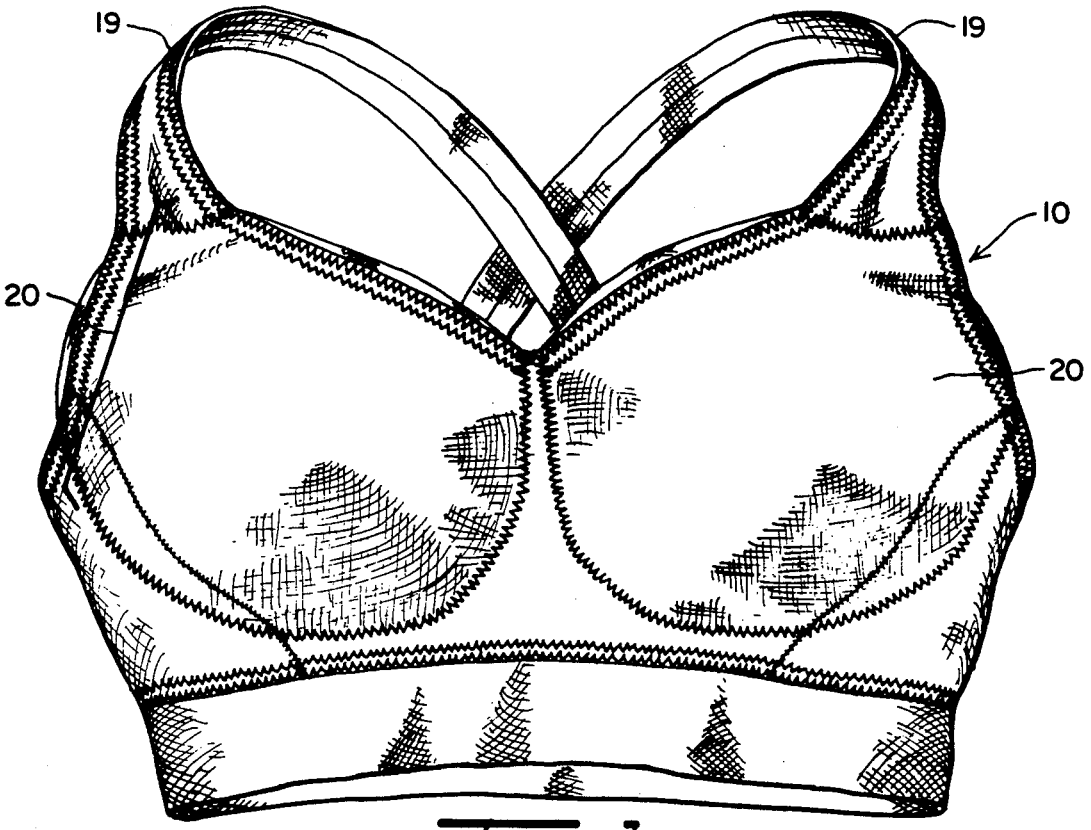
FIG. 1 is a front view of the protective brassiere.

Referring now more specifically to the drawings, and with specific reference to the embodiment shown in FIG. 1, it will be seen that a protective support brassiere, from a front perspective view, is illustrated in accordance with the objects of the invention and comprises a breast fitting sheath like member 10 having a pair of cup pockets 20—20 formed therein. In the form of the brassiere illustrated and described herein the outermost side sections of the sheath 10 are provided with extensions 19—19 of fabric or other similar material which surrounds the upper rib cage. The one piece construction allows the bra to be pulled down over the wearer's head, thereby making any fasteners at the end of extensions 19—19, unnecessary. In addition, the approximately 3 to 4 inches of elastic band under the breast circumferencing the upper body rib area supports the bra and protective cups.

The sheath 10 can be formed in any known way as long as it can adequately support two protective cups 15—15 that are inserted within an opening 25 wide enough along the bottom of the cup pocket 20—20 area of said sheath 10 so that the cups can be easily inserted or removed. The placement of openings 25 on the sheath 10 are such that they will secure the cups 15—15 in position, in addition to being secured by a fastening means such as an overflap, by VELCRO, or snap buttons 26.

The presently disclosed brassiere can easily be manufactured using cotton (for absorbing), and LYCRA/-SPANDEX material with adequate back support, as is well known in the art. While these are preferred materials, the invention disclosed herein is intended to encompass any other suitable materials such as molded latex which is also capable of suitably protecting and supporting the breasts.

Figure 2:
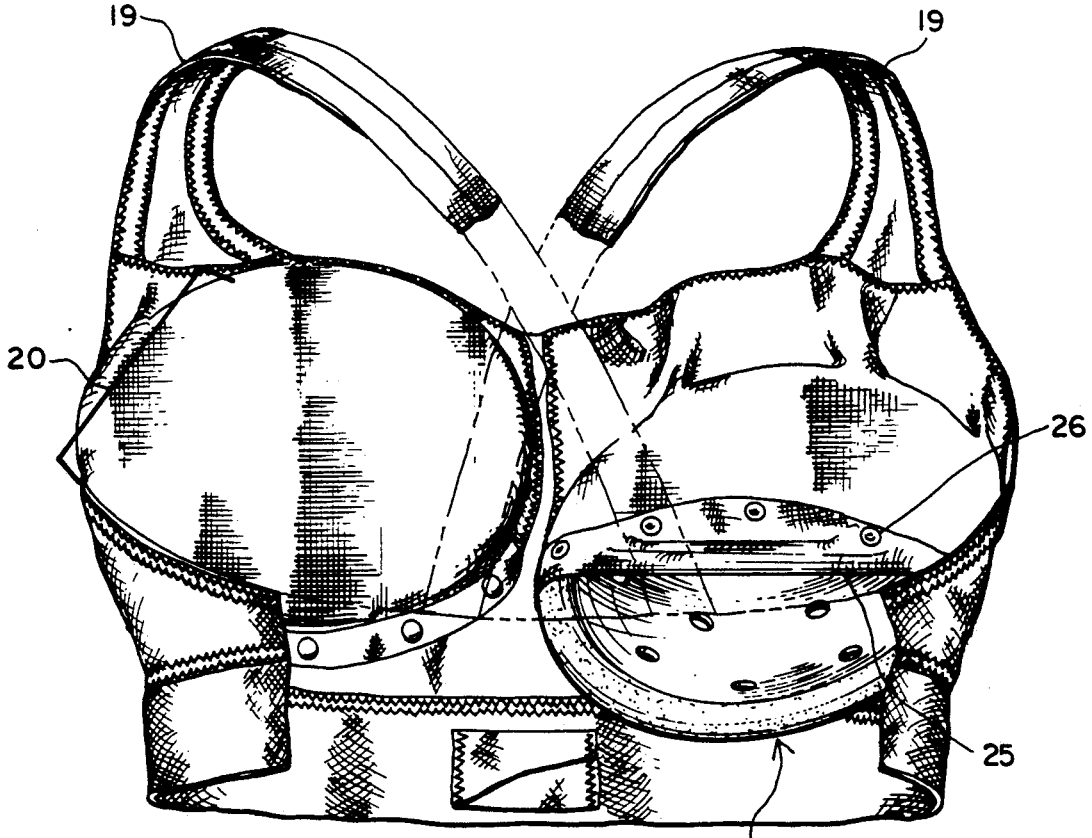
FIG. 2 is a side view of the protective brassiere which consists of stretch material which can be opened along the bottom to insert the semi-rigid protective cups that can be fastened with velcro, snaps or overflap.

As is shown in FIG. 2 the protective cups 15—15, which are removably secured within the walls of sheath 10, are constructed from semi-rigid plastic or any similar suitable flexible material. Additionally, the protective brassiere consists of stretch material which can be opened along the bottom to insert the protective cups that can be fastened with velcro, snaps or overflaps.

Figure 3:
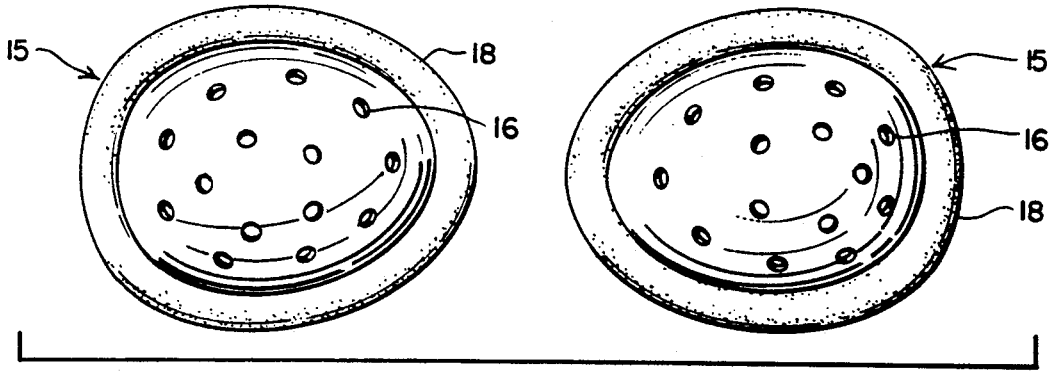
FIG. 3 is a front view of the protective cups.

While a semi-rigid hemispherical cup 15 is disclosed in FIG. 3, it could be of any suitable shape, depending on the latest design or fashion considerations. The cup 15 is sized to encompass the entire breast area, and is intended to be centered about the nipple of the breast. The protective cup 15 may be comfortably worn under any clothing. The body of the protective cups 15—15 are perforated for maximum ventilation and air flow by 8–10 air holes 16. The sheath and of the interior of the cups 15—15 are sized similarly to known brassiere sizes (e.g. AAA, AA, A, B, C, D, E etc.).

Figure 4:
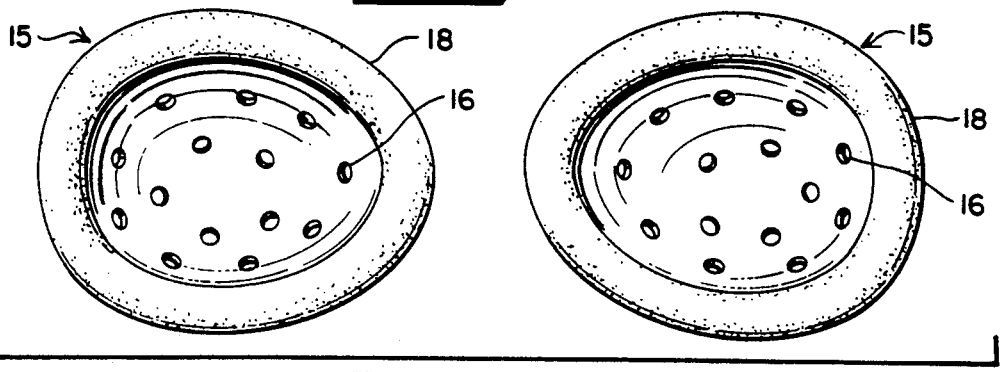
FIG. 4 is a rear view of a protective cup showing the shock absorbing material around the inner rim.
Figure 5:
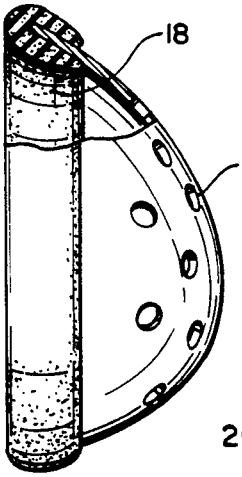
FIG. 5 is a side view of a protective breast cup, constructed of semi-rigid plastic, and showing the shock absorbing material, surrounding the inner and outer perimeter of the protective cup.

FIG. 4 is a rear view of a protective cup showing the shock absorbing material around the inner rim. In the disclosed embodiment, around the inner and outer edges of each cup 15 is a thick, firm strip of removable rubber 18. According to one preferred embodiment, the measurements of the width for the rubber strip 18 is 1½ inches wide when flattened and ¾ inches when folded. This is for all cup sizes. For an average B cup bra, for example, the length of the rubber strip 18 would thus be 16¼ inches. The strip 18 can also be constructed from any similar suitable shock absorbing material other than rubber. Both the cups 15—15 and the rubber strips 18—18 can be easily removed and sponged down with soap and water whenever necessary. Not only will the vented cups 15—15 effectively absorb direct blows, but the wide strips of rubber attached to the inner and outer circumference of the cups, will also help comfortably keep the breasts from excessive movement causing injury and/or discomfort.

Figure 6:
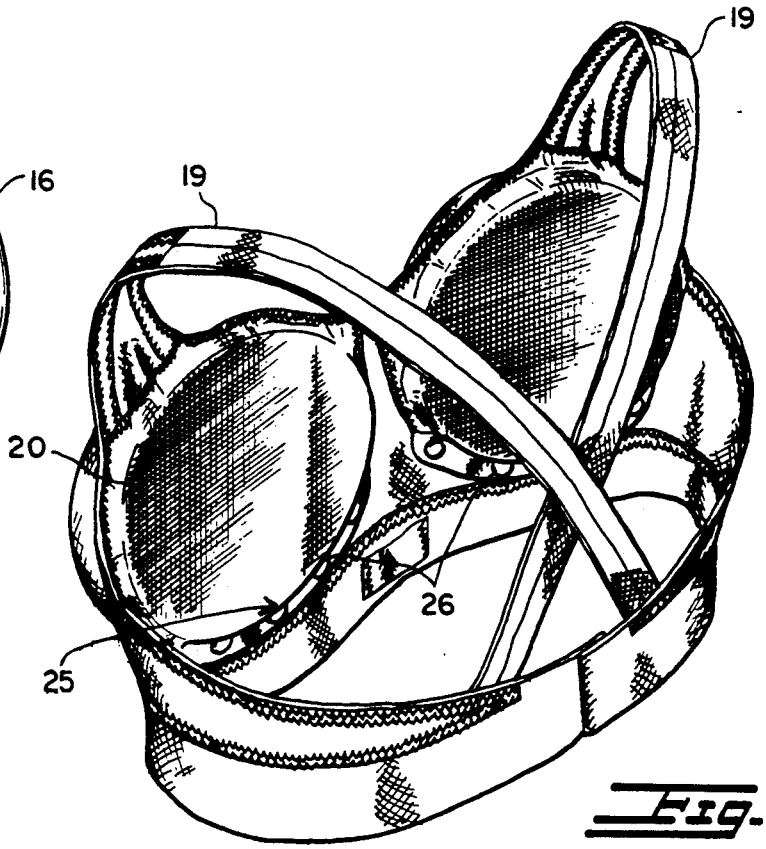
FIG. 6 is a prospective view of the protective cups fully secured in the bra.

As disclosed in FIG. 6 the protective cups are fully secured in the bra. In addition, the bra can be worn without the protective cups inserted therein.

Since the invention is described and illustrated with reference to but a single, preferred embodiment, and since numerous modifications and changes will become readily apparent to those skilled in the art after reading this disclosure, it should be understood that we do not wish to limit the scope of our invention to the exact construction shown and described above, and as claimed by us below.

We claim:

1. A new, comfortable brassiere to protect an entire breast area from damaging impact and excessive movement comprising;

a sheath, made of cotton, having two pockets designed to cover the breast area;

the two pockets having an opening arranged along the bottom of the sheath;

two semi-rigid cups, each cup having 8–10 vent holes; and each cup having a strip of shock absorbing material which is operatively and removably attached around its inner and outer edge; fastening means removably securing said cups in the cup pockets along the bottom of the sheath.

2. The brassiere according to claim 1 wherein said shock absorbing material consists of wide bands of rubber.

3. In a brassiere for protecting and supporting an entire breast area against sudden impact and excessive physical movement wherein two semi-rigid cups, each having an inner and outer circumference and each cup having vent holes therein, are removably secured within cup pockets arranged in said brassiere, the improvement comprising an opening along the bottom of said pockets and wide bands of shock absorbing material are operatively and removably connected around the hard, outer and inner circumference of said cups, thereby protecting the breast upon impact while simultaneously restraining them from bouncing; and wherein the cups, are made of a semi-rigid plastic having 8–10 vent holes; and fastening means removably securing said cups in the cup pockets, along the bottom of the cup pockets.

4. The brassiere of claim 2 wherein said shock absorbing material consists of wide bands of rubber which surround edges both inside and out of the eup edges.

5. The brassiere of claim 1 wherein said sheath is made of molded latex.

6. The brassiere of claim 1 wherein said strip of shock absorbing material is rubber which is 1½ inches wide when flattened and ¾ inches when folded.

* * * * *